United States Patent [19]

Weidmann

[11] Patent Number: 4,483,265

[45] Date of Patent: Nov. 20, 1984

[54] CROSS-STITCH DESIGN PROCESS

[76] Inventor: Kathy A. Weidmann, 12732 Spinnaker St., Garden Grove, Calif. 92640

[21] Appl. No.: 425,068

[22] Filed: Sep. 27, 1982

[51] Int. Cl.[3] ..... D05C 3/00

[52] U.S. Cl. ..... 112/266.1

[58] Field of Search ..... 112/266.1

[56] References Cited

U.S. PATENT DOCUMENTS

| | | | |
|---|---|---|---|
| 207,141 | 8/1878 | Smith | 112/266.1 |
| 298,025 | 5/1884 | Pulaski | 112/266.1 |
| 865,640 | 9/1907 | Haberer | 112/266.1 |
| 889,614 | 6/1908 | Johnsen | 112/266.1 |
| 1,560,283 | 11/1925 | Mehlem | 112/266.1 |

*Primary Examiner*—Doris L. Troutman

*Attorney, Agent, or Firm*—Gausewitz, Carr, Rothenberg & Edwards

[57] ABSTRACT

This invention provides a cross-stitching arrangement in which a desired embroidery pattern first is laid out in outline form on a paper and then reproduced by stamped crosses on the material that is to receive the cross-stitching. The paper layout may be on quadrille paper with rows of aligned squares encompassed within the pattern corresponding in size and position to the crosses to be stitched to the material. Alternatively, the pattern may be laid out on plain paper with crosses applied in aligned rows as defined by the pattern, these rows of crosses then being reproduced on the material in giving the locations of the cross-stitches to be made. The stamping of the material, and of the paper in the alternate procedure, is accomplished by a stamp having a predetermined size of cross marking.

9 Claims, 5 Drawing Figures

CROSS-STITCH DESIGN PROCESS

BACKGROUND OF THE INVENTION

Conventional cross-stitching techniques have left the needleworker with little opportunity for originality and with a limited choice of designs. Much cross-stitching is accomplished by working with cloth which has been printed with a design that is to be followed in making the cross-stitches. This, of course, limits the needleworker to the design already on the fabric. Other cross-stitching is done by creating a design through counting the threads of the fabric to obtain positions where cross-stitches are to be made. This is very difficult and slow in operation, and may be impractical for some tightly woven fabrics. Designs also have been applied to material through the use of carbon paper, or iron-on transfers. Transfers provide the needleworker with no opportunity for creating a design and carbon paper is difficult to use with results that are less than satisfactory. Other procedures have had similar drawbacks.

SUMMARY OF THE INVENTION

The present invention provides a simple procedure by which virtually any design may be applied to material and reproduced in embroidery. The technique is easy to follow, requires almost no investment and produces designs on material which are readily followed by the needleworker.

In following the invention, a design may be applied first to quadrille paper, outlining squares that correspond to cross-stitches to be made in the completed embroidery work. A rubber stamp in the shape of a cross, corresponding to the diagonals of the squares on the quadrille paper, then is used in reproducing the pattern on the material to be embroidered. Horizontal and vertical reference lines are applied to the material to aid in the positioning of the crosses stamped on the material. The crosses on the material provide direct visual indications where the cross-stitches are to be made with the thread simply passing over the markings on the fabric. When the design is complete, the ink, which is washable, is washed away. As an alternative, the design may be drawn initially on plain paper, marked also with horizontal and vertical reference lines. Then, the stamp is used to provide aligned rows of crosses on the paper to reproduce or approximate the pattern drawn on the paper. These rows of crosses may then be applied to the material as before to provide indications of where the cross-stitches are to be made.

DETAILED DESCRIPTION OF THE PREFERRED EMBODIMENTS

Initially the desired pattern 10 is sketched on a first medium which is a sheet of conventional quadrille paper 11 which has horizontal and vertical lines 12 and 13, respectively, defining parallel rows of aligned squares 14. In the embodiment illustrated, the pattern 10 represents a stylized flower with blossom and leaves made to comply with the normal technique of cross-stitching in which a pattern is made up of crosses stitched on a fabric. Preferably, the pattern 10 is sketched primarily along the horizontal and vertical lines 12 and 13 of the quadrille paper so as to encompass mostly full squares 14. In this design, each of the full squares 14 within the pattern 10 represents one cross in the final needlework pattern. Thus, the number and the positions of the final cross-stitches are established by the squares of the pattern 10. The two legs of the crosses will correspond in length and position to the two diagonals of the full squares enclosed by the pattern, as explained below.

Figure 5:
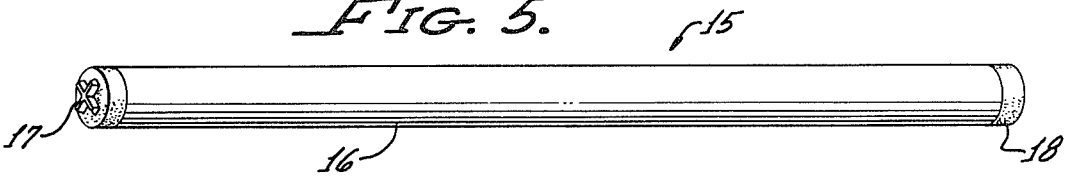

Next, a layout of the cross-stitch pattern is made on a second medium,: i.e. a piece of cloth material. This is done by an inking tool 15, as shown in FIG. 5, which is made up of an elongated rod 16 with a rubber stamp 17 at one end which will imprint a cross. The cross produced by the stamp 17 is approximately the same size as, or slightly smaller than, the diagonals of the squares 14 on the quadrille paper 11. For added versatility, the tool 15 may include a second stamp 18 at the opposite end of a different size usable with paper marked with squares of another size.

Figure 2:
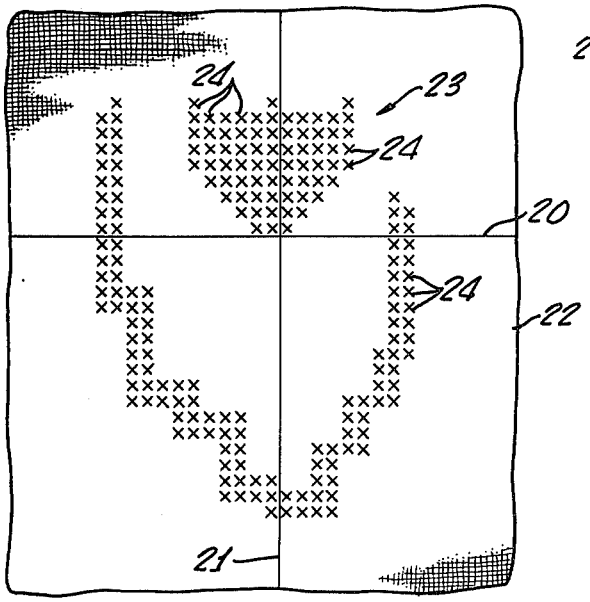
FIG. 2 is a plan view of the fabric with the pattern reproduced by inkstamped crosses.
Figure 3:
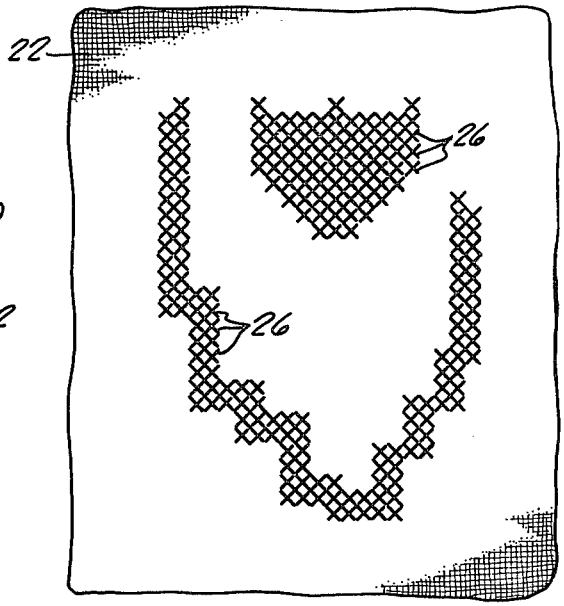
FIG. 3 is a plan view of the completed cross-stitching on the fabric.

It is preferred to mark horizontal and vertical lines 20 and 21, respectively, on the material 22, as seen in FIG. 2, which act as a reference lines as the design is formed. Normally, the lines 20 and 21 follow the warp and wool of the fabric. The inking tool 15 then is used to produce an ink pattern 23 on the material 22 corresponding to the pattern 10 in the quadrille paper 11. The pattern 23 is formed by reproducing the pattern 10, filled in with crosses 24 instead of squares as on the paper 11, the crosses having the orientation of the diagonals of the squares. Washable ink is used for the crosses 24 as well as the lines 20 and 21. The crosses 24 are built into the pattern by counting the number of squares in each row on the pattern 10 and reproducing a similar number of crosses 24 on the material 22. For example, in the pattern 10 it can be seen that there are three full squares 14 in the row of squares that forms the bottom of the blossom. Therefore, three crosses 24 are stamped on the material 22 to correspond to this part of the pattern. For ease in positioning these crosses 24, they may be placed along the horizontal line 20. Next, crosses 24 may be put on the material 22 to correspond to the second row of squares 14 forming the blossom of the quadrille pattern 10, which are in a row of five. Three of these crosses 24 are made directly above the three crosses 24 in the lowermost row, just as the three squares 14 at the center of the second row of the pattern 10 are directly above the three squares 14 in the bottom row of the blossom of that pattern. The vertical line 21 may be referred to as an aid to obtaining vertical alignment of the crosses of these two rows. An additional cross 24 is added on either end of the second row in the manner of the squares 14 in the pattern 10. This procedure is continued until the entire pattern is constructed. The portion of the pattern 10 representing the leaves of the flower is separate from the blossom, in the example illustrated, and its starting position may be found by simple measurement, such as the vertical distance along the reference line 18 at the bottom portion of the part of the pattern representing the leaves. Usually the partial squares 14 of the pattern 10 are eliminated in the pattern 23.

With the pattern 23 completed on the cloth 22, the cross-stitching then is accomplished. The crosses 26 of embroidery thread, therefore, are made directly over and guided by the stamped crosses 24. In forming the crosses 26, it is preferred to run all stitches in the same direction first, starting from the bottom of the pattern and working diagonally upwardly, from right to left. Then the stitches in the other direction along the opposite diagonal are formed. When all of the cross-stitches 26 have been made in the fabric 22, it is immersed in water to remove the ink that had imprinted the crosses 24 and the lines 20 and 21. This completes the cross-stitching operation.

Figure 1:
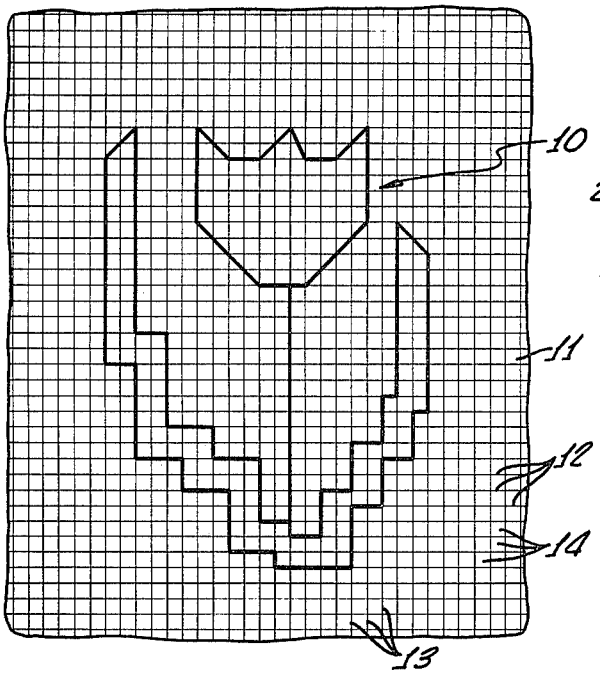
FIG. 1 is a plan view of a sheet of quadrille paper upon which has been drawn a pattern that is to be applied to the fabric.
Figure 4:
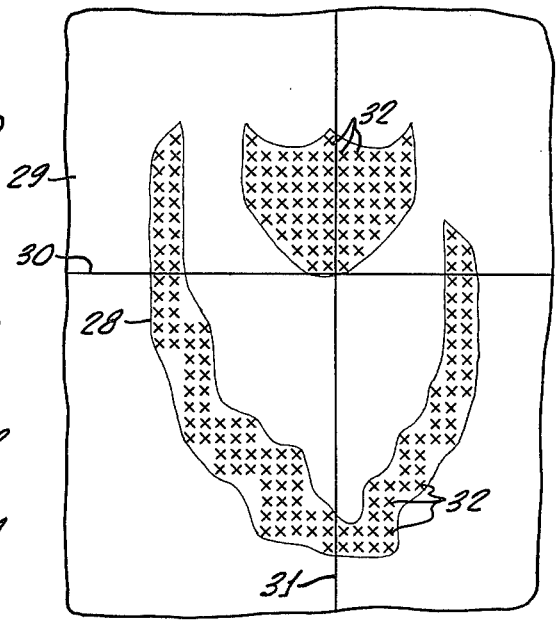
FIG. 4 is a plan view of an alternative arrangement in which the pattern first is formed on plain pattern; and, FIG. 5 is a perspective view of the stamp used in applying the crosses to create the pattern.

FIG. 4 illustrates an alternative arrangement for producing a paper pattern of a design of crosses which can be used in lieu of the arrangement of FIG. 1. Here, an outline 28 of the desired pattern is sketched on a piece of plain paper 29. This pattern may include curved lines not initially reflecting the square increment construction of a cross-stitch design. Horizontal and vertical lines 30 and 31, respectively, are drawn on the paper 29 through the outline 28. Next the outline 28 is filled in with stamped crosses 32, using the stamping tool 15. A straight edge should be used to facilitate accurately locating the stamped crosses 32 and keeping them properly correlated with the lines 30 and 31. The stamped crosses 32 will not follow the curved outline 28 precisely because a cross-stitching pattern is built of rectangular increments. However, an approximation of the outline 28 is produced and the result may be the same as that obtained when the design is formed on quadrille paper 11. Again, the number and the position of crosses to be cross-stitched are established by the paper pattern.

After the layout of FIG. 4 has been made, the crosses are stamped on the cloth in the same manner as shown in FIG. 2. Instead of counting squares to represent the crosses to be placed on the pattern, the stamped crosses 32 are counted on the paper layout and reproduced on the cloth. After this, the cross-stitches are made and the pattern is completed.

The foregoing detailed description is to be clearly understood as given by way of illustration and example only, the spirit and scope of this invention being limited solely by the appended claims.

I claim:

1. The method of producing an embroidered work made up of cross-stitches of predetermined dimensions comprising the steps of producing on a first medium a pattern, establishing the positions of crosses of said predetermined dimension aligned in parallel rows which can be substantially encompassed by and at least approximating the contour of said pattern, marking on a second medium crosses corresponding to those so encompassed by said pattern, and then stitching over said crosses as marked on said second medium cross-stitches of said predetermined dimension, thereby to produce said pattern on said second medium.

2. The method as recited in claim 1 in which for marking said crosses on said second medium a stamp is prepared having a cross thereon corresponding substantially to said predetermined dimension, and in which said stamp is used to imprint aligned rows of said crosses on said second medium in the form of said pattern.

3. The method as recited in claim 1 in which said first medium is a sheet of quadrille paper having squares thereon the diagonals of which correspond substantially to said predetermined dimension of said cross-stitches, and said pattern outline is formed on said sheet of quadrille paper by following primarily the lines of said paper so as to provide rows of squares within an outline, said squares corresponding in position to said crosses of said predetermined dimension.

4. The method as recited in claim 1 in which establishing the positions of crosses encompassed by said pattern, aligned rows of crosses of substantially said predetermined dimension are marked on said first medium substantially within said pattern and approximating the contour thereof.

5. The method as recited in claim 1 in which in so marking on a second medium crosses corresponding to those so encompased by said pattern, reference lines are formed on said second medium, said reference lines including two lines at right angles to each other, and said aligned rows of crosses are so marked on said second medium so as to be parallel to one of said lines and perpendicular to the other of said lines.

6. The method as recited in claim 5 in which said crosses and said lines so marked on said second medium are marked with washable ink, and including the step of washing out said washable ink after producing said cross-stitches on said second medium.

7. The method of embroidering by cross-stitching comprising the steps of drawing a pattern on a first medium, drawing reference lines perpendicular to each other through said pattern, p1 filling in said pattern and following at least approximately the outer periphery thereof by marking on said first medium crosses arranged in rows perpendicular and parallel to said lines, drawing reference lines perpendicular to each other on a second medium, marking said second medium with crosses so as to reproduce the arrangement of crosses on said first medium with said crosses on said second medium being positioned in rows perpendicular and parallel to said reference lines on said second medium, and then stitching cross-stitches over said crosses so marked on said second medium.

8. The method as recited in claim 7 in which said crosses are so marked on said second medium by stamping.

9. The method of embroidering by cross-stitching comprising the steps of drawing a pattern on quadrille paper primarily following the lines of said paper so as to encompass a plurality of squares arranged in parallel rows, stamping a piece of cloth with crosses so as to reproduce in crosses the arrangement of said squares on said quadrille paper substantially encompassed by said pattern, and then stitching cross-stitches over said crosses so stamped on said piece of cloth.

* * * * *